US012644069B2

(12) United States Patent
Bosco et al.

(10) Patent No.: US 12,644,069 B2
(45) Date of Patent: Jun. 2, 2026

(54) BIODEGRADABLE LUBRICATING GREASES

(71) Applicant: TOTALENERGIES ONETECH, Courbevoie (FR)

(72) Inventors: Lionel Bosco, Solaize Cedex (FR); Jeremy Levrier, Solaize Cedex (FR)

(73) Assignee: TOTALENERGIES ONETECH, Courbevoie (FR)

( * ) Notice: Subject to any disclaimer, the term of this patent is extended or adjusted under 35 U.S.C. 154(b) by 0 days.

(21) Appl. No.: 18/853,689

(22) PCT Filed: Apr. 4, 2023

(86) PCT No.: PCT/EP2023/058732

§ 371 (c)(1),
(2) Date: Oct. 2, 2024

(87) PCT Pub. No.: WO2023/194332

PCT Pub. Date: Oct. 12, 2023

(65) Prior Publication Data

US 2025/0236806 A1 Jul. 24, 2025

(30) Foreign Application Priority Data

Apr. 5, 2022 (FR) ..... 2203079

(51) Int. Cl.

| | |
|---|---|
| ***C10M 169/02*** | (2006.01) |
| ***C10M 169/04*** | (2006.01) |
| ***C10N 20/00*** | (2006.01) |
| ***C10N 20/06*** | (2006.01) |
| ***C10N 30/00*** | (2006.01) |
| ***C10N 50/10*** | (2006.01) |

(52) U.S. Cl.

CPC ..... *C10M 169/02* (2013.01); *C10M 169/04* (2013.01); *C10M 2201/062* (2013.01); *C10M 2207/2805* (2013.01); *C10M 2227/006* (2013.01); *C10N 2020/06* (2013.01); *C10N 2020/081* (2020.05); *C10N 2030/64* (2020.05); *C10N 2050/10* (2013.01)

(58) Field of Classification Search

CPC ..... C10M 169/02; C10M 169/04; C10M 2201/062; C10M 2207/006; C10M 2207/2805; C10N 2020/06; C10N 2020/081; C10N 2030/64; C10N 2050/10

See application file for complete search history.

(56) References Cited

U.S. PATENT DOCUMENTS

| | | | | |
|---|---|---|---|---|
| 9,951,292 | B2 * | 4/2018 | Genet | C10M 169/02 |
| 2018/0030367 | A1 * | 2/2018 | Worthington | C10M 105/06 |
| 2021/0277323 | A1 | 9/2021 | Mayrhofer et al. | |

OTHER PUBLICATIONS

International Search Report and Written Opinion for International Application No. PCT/EP2023/058732, dated Jul. 18, 2023.

* cited by examiner

*Primary Examiner* — James C Goloboy

(74) *Attorney, Agent, or Firm* — DUANE MORRIS LLP; Gregory M. Lefkowitz; Brandon A. Chan

(57) ABSTRACT

The present disclosure concerns a grease composition comprising relative to the total weight of the grease composition:

a) from 70 to 95% by weight of base oil(s) each having a 28-day biodegradability of at least 60% as measured according to standard OECD 301B, b) from 1 to 20% by weight of thickener(s) chosen from among fatty acid metal salts, each thickener having a 28-day biodegradability of at least 60% as measured according to standard OECD 301B;

c) from 0.5 to 10% by weight of calcium carbonate having a D50 particle size greater than or equal to 3 μm and a D90 particle size greater than or equal to 10 μm.

17 Claims, No Drawings

BIODEGRADABLE LUBRICATING GREASES

The present disclosure relates to the field of greases, in particular for off-road, agricultural and wind energy markets, having improved antiwear and extreme pressure properties and high biodegradability.

TECHNICAL FIELD

There are numerous applications for which liquid lubricants are not suitable since they «drift» from the lubrication point. These particular concern bearings (ball, roller, needle), rolling and slide bearings, open gears, metal cables and chain drives, and more generally applications not comprising a sealing system.

For these applications lubricating greases are used, these being solid or semi-fluid substances resulting from the dispersion of a thickener in a liquid lubricant, optionally integrating additives imparting special properties thereto.

The greases currently used generally comprise mineral oils of fossil origin which do not have high biodegradability. Document U.S. 2018/0030367 discloses a grease composition.

Industrialists are increasingly seeking to formulate compositions for biodegradable greases, in particular for greases requiring regular renewal e.g. for applications involving a high risk of leakage.

Document U.S. 2021/0277323 discloses a lubricating grease having a low impact on the environment.

In some applications, in particular for off-road markets (of construction equipment or agricultural machinery type) and wind energy markets (wind turbines), the demands placed on ever more powerful machines take place under increasingly harsher conditions, meaning that the products for lubrication thereof in addition to being biodegradable must also provide significant gains in performance in terms of extreme pressure properties.

It is therefore an objective of the present invention to provide a grease composition comprising a base oil and a thickener, both biodegradable, which also affords excellent antiwear and extreme-pressure properties and good adhesivity.

SUMMARY OF THE INVENTION

More specifically, the present invention concerns a grease composition comprising, relative to the total weight of the grease composition:

a) from 70 to 95% by weight of base oil(s) each having a 28-day biodegradability of at least 60% (as measured according to standard OECD 301B;

b) from 1 to 20 weight %, preferably 2 to 20% by weight of thickener(s) chosen from among fatty acid metal salts, each thickener having a 28-day biodegradability of at least 60% as measured according to standard OECD 301B;

c) from 0.5 to 10% by weight of calcium carbonate having a D50 particle size greater than or equal to 3 μm and a D90 particle size greater than or equal to 10 μm.

In one embodiment, the grease composition of the invention is characterized in that it has 28-day biodegradability of at least 60%, calculated from the 28-day biodegradability of the base oil(s) and thickener(s), the 28-day biodegradability of the base oil(s) and thickener(s) being measured according to standard OECD 301B.

Preferably, the thickener is chosen from among optionally hydroxylated lithium salts of fatty acids, optionally hydroxylated calcium salts of fatty acids and the mixtures thereof, preferably from optionally hydroxylated lithium salts of fatty acids, preferably lithium 12-hydroxystéarate.

Preferably, the base oils are chosen from among ester oils.

Preferably, the calcium carbonate has a D50 particle size ranging from 3 to 20 μm and a D90 particle size ranging from 10 to 50 μm.

Preferably, the grease composition of the invention additionally comprises at least one extreme pressure additive, preferably in an amount ranging from 1 to 15% by weight relative to the total weight of the composition.

Preferably, the grease composition of the invention is free of antiwear additive of amine phosphate type, of zinc diamyldithiocarbamate type and of zinc dialkyl dithiophosphate type.

Preferably, the grease composition of the invention comprises at least 40% by weight of carbon of biological origin, preferably at least 45% by weight of carbon of biological origin, relative to the total weight of carbon atoms of the composition.

The invention also concerns the use of the grease composition of the invention in an off-road, agricultural or wind energy device.

Preferably, the off-road, agricultural or wind energy device is chosen from among construction equipment, agricultural machinery and wind energy turbine.

The grease composition of the invention has excellent antiwear and extreme pressure properties and good adhesivity, even in the absence of an antiwear additive.

In particular, the grease composition of the invention typically has the following properties:

extreme-pressure property, under the 4-Ball test according to standard ASTM D2596, of 500 kgf;

a low wear of around 0.5 mm, according to standard ASTM D2266;

a water spray off result lower than 30% of loss according to standard ASTM D4049.

The grease composition of the invention typically has high biodegradability.

In the remainder hereof, the expressions «between . . . and . . . », «ranging from . . . to . . . » and «varying from . . . to . . . » are equivalent and are intended to mean that the limits are included unless otherwise indicated.

Unless otherwise stated, the quantities in a product are expressed by weight relative to the total weight of the product.

DETAILED DESCRIPTION

The present invention concerns a grease composition comprising, relative to the total weight of the grease composition:

a) from 70 to 95% by weight of base oil(s) each having a 28-day biodegradability of at least 60%, as measured according to standard OECD 301B, b) from 2 to 20% by weight of thickener(s) chosen from among fatty acid metal salts, each thickener having a 28-day biodegradability of at least 60%, as measured according to standard OECD 301B, c) from 0.5 to 10% by weight of calcium carbonate having a D50 particle size greater than or equal to 3 μm and a D90 particle size greater than or equal to 10 μm, optionally from 1 to 15% by weight of additive(s), said additives differing from the base oils a), differing from the thickeners b) and differing from the calcium carbonate c).

Preferably, the grease composition of the invention is biodegradable.

In the meaning of the present invention, a «compound» is said to be «biodegradable» if it has 28-day biodegradability of at least 60% as measured according to standard OECD 301B.

In the meaning of the present invention, the «grease composition» is said to be «biodegradable» if the biodegradability thereof calculated from the biodegradability of the base oil(s) and thickener(s), weighted by the proportions of said base oil(s) and thickener(s) in said grease composition, is at least 60% at 28 days.

For example, if the grease composition comprises:

- v % by weight of a base oil having a 28-day biodegradability Bv % measured according to standard OECD 301B;
- y % by weight of a base oil having a 28-day biodegradability By % measured according to OECD 301B,
- z % by weight of a thickener having a 28-day biodegradability Bz % measured according to standard OECD 301B,
- q % by weight of calcium carbonate;
- t % by weight of additive(s),
- then the 28-day biodegradability of the grease composition Bc expressed as a percentage will be calculated as follows: Bc=v %×Bv+y %×By+z %×Bz.

Base Oil(s)

The grease composition used in the invention comprises one or more biodegradable base oils.

Preferably, the grease composition comprises at least one base oil of renewable origin e.g. of vegetable or animal origin.

Preferably, the base oils of renewable origin represent at least 75% by weight of the total weight of the base oils.

In one embodiment, all the base oils of the grease composition of the invention have 28-day biodegradability of at least 60% as measured according to standard OECD 301B.

A mixture of several base oils can be used, e.g. a mixture of two, three or four base oils.

In one embodiment, the grease composition comprises at least one base oil of ester type.

10 Preferably, the base oil(s) of ester type represent at least 50% by weight, preferably at least 70% by weight of the total weight of the base oils.

Among those esters able to be used as base oil, mention can be made of polyol esters.

The polyol esters able to be used as base oil are for example diesters, triesters, tetraesters, or complex esters having more than four ester functions.

The acids able to be used to form the esters are monocarboxylic acids or dicarboxylic acids.

Preferably, the monocarboxylic acids have 3 to 22 carbon atoms, preferably 4 to 20, more preferably 6 to 18, further preferably 8 to 16, and still further preferably 10 to 12.

Mention can be made for example of hexanoic, octanoic, 2-ethylhexanoic, isooctanoic, nonanoic, decanoic, isodecanoic, oleic, stearic acids. Preference is given to saturated acids not comprising any unsaturations.

Preferably, the dicarboxylic acids have 3 to 22 carbon atoms, preferably 4 to 20, more preferably 6 to 18, further preferably 8 to 16, and still further preferably 10 to 12. Succinic, adipic, azelaic, sebacic acids can be cited for example.

The alcohols able to be used to form the esters are monoalcohols (formation of diesters with dicarboxylic acids), dialcohols, trialcohols or tetraalcohols. The preferred alcohols are polyols such as neopentylglycol, trimethylolpropane, pentaerythritol.

The base oil or mixture of base oils preferably have viscosity at 40° C. higher than or equal to 100 cSt, preferably higher than or equal to 200 cSt, more preferably higher than or equal to 300 cSt, further preferably higher than or equal to 400 cSt, still further preferably higher than or equal to 500 cSt.

Viscosity is preferably measured according to standard ASTM D445.

The base oil(s) preferably represent from 70 to 95% by weight, preferably 75 to 90% by weight of the total weight of the grease composition.

The base oils able to be used in the present invention are commercially available products.

Thickener

The grease composition of the invention comprises at least one thickener chosen from among fatty acid metal salts.

Preferably, the grease composition of the invention is free of thickeners of polyurea type.

The fatty acid metal salts can be chosen from among the metal salts of fatty monoacids or the metal salts of fatty diacids, said monoacids or said diacids preferably having 8 to 28 carbon atoms.

Preferably long chain fatty acids are used typically comprising 10 to 28 carbon atoms, saturated or unsaturated and optionally hydroxylated.

Long chain fatty acids (typically having 10 to 28 carbon atoms) are for example capric, lauric, myristic, palmitic, stearic, arachidic, behenic, oleic, linoleic, erucic acids and the hydroxylated derivatives thereof. The preferred derivative is 12-hydroxystearic acid.

Lithium 12-hydroxystearate is the preferred thickener for the grease composition of the invention.

These long chain fatty acids are generally derived from vegetable oils e.g. palm, castor, rapeseed, sunflower seed oils . . . or from animal fats (tallow, whale oil . . . ).

So-called simple soaps can be formed using one or more long chain fatty acids, typically monoacids.

It is also possible to form so-called complex soaps using one or more long chain fatty acids in combination with one or more carboxylic diacids comprising a short hydrocarbon chain having at most 10 carbon atoms. In one embodiment, the carboxylic acids comprising a short hydrocarbon chain are chosen from among carboxylic monoacids and diacids preferably having 3 to 10 carbon atoms.

The saponification agent used for produce the soap can be a lithium, sodium, calcium, aluminum metal compound, preferably lithium and calcium, and preferably a hydroxide, oxide or carbonate of these metals.

One or more metal compounds can be used in the greases of the invention, whether or not having the same metal cation. It is therefore possible to associate lithium soaps, combined with calcium soaps in a lesser proportion.

The thickener(s) preferably represent 3 to 20% by weight, preferably 4 o 15% by weight, more preferably 5 to 12% by weight of the total weight of the grease composition.

The thickeners able to be used in the present invention are commercially available products.

Calcium Carbonate

The grease composition of the invention comprises calcium carbonate having a D50 particle size greater than or equal to 3 μm and a D90 particle size greater than or equal to 10 μm.

In the meaning of the present invention, particles having a D50 particle size of X μm means that 50% by volume of the particles have a size smaller than X μm and 50% by volume have a size greater than X μm.

In the meaning of the present invention, particles having a D90 particle size of X μm means that 90% by volume of the particles have a size smaller than X μm and 10% by volume of the particles have a size greater than X μm.

The D50 and a D90 particle size can be measured by laser diffraction, using any method well known to skilled persons. One example of a method is detailed in the experimental section.

In one embodiment, the calcium carbonate has a D50 particle size ranging from 3 to 20 μm and a D90 particle size ranging from 10 to 50 μm, preferably a D50 particle size ranging from 4 to 15 μm and a D90 particle size ranging from 10 to 40 μm.

In one embodiment, the calcium carbonate has a D50 particle size ranging from 5 to 10 μm and a D90 particle size ranging from 10 to 30 μm.

The inventors have discovered that calcium carbonate having a particle size as defined in the present invention allows both good antiwear properties to be obtained and good extreme-pressure properties.

In the state of the art, the calcium carbonate generally used as antiwear agent has a much smaller particle size (nanometric).

The calcium carbonate represents from 0.5 to 10% by weight, preferably 1 to 5% by weight, more preferably 2 to 4% by weight of the total weight of the grease composition of the invention.

The calcium carbonate particles able to be used in the present invention are commercially available products.

Additive(s)

The grease composition of the invention optionally comprises one or more other additives differing from the base oils a), differing from the thickeners b) and differing from the calcium carbonate c), as previously defined.

In one embodiment, the other additives are chosen from among extreme-pressure additives, antioxidant additives, anticorrosion additives, metal passivating additives, and mixtures thereof.

These additives can be added alone and/or in the form of a mixture.

The grease composition of the invention may comprise at least one antioxidant additive. The antioxidant additive can be chosen from among antioxidants of phenolic or amine type.

The antioxidant additives can particularly be chosen from among sterically hindered phenols, sterically hindered phenol esters, and sterically hindered phenols comprising a thioether bridge, and the mixtures thereof.

Amine compounds are another class of antioxidant additives able to be used, optionally in combination with phenolic antioxidant additives. Examples of amine compounds are aromatic amines e.g. aromatic amines of formula $NR^{10}R^{11}R^{12}$ where $R^{10}$ is an optionally substituted aliphatic group or aromatic group, $R^{11}$ is an optionally substituted aromatic group, $R^{12}$ is a hydrogen atom, an alkyl group, aryl group or group of formula $R^{13}S(O)_zR^{14}$ where $R^{13}$ is an alkylene group or alkenylene group, $R^{14}$ is an alkyl group, alkenyl group or aryl group and z is 0, 1 or 2. Among the antioxidants of amine type, mention can be made of diphenylamines, diphenylamines substituted by at least one $C_1$-$C_{12}$ alkyl group, N,N'-dialkyl-aryl-diamines, and mixtures thereof.

The grease composition of the invention may comprise from 0.05 to 5% by weight, preferably 0.1 to 4% by weight, or 0.2 to 2% by weight of antioxidant agent relative to the total weight of the composition.

In one embodiment, the grease composition comprises at least one extreme-pressure additive.

In one embodiment, the grease composition comprises from 2 to 10% by weight of at least one extreme-pressure additive relative to the total weight of the grease composition.

Preferably, the extreme-pressure additive is chosen from among sulfur-containing olefins, sulfurized fatty acid esters, and mixtures thereof.

Sulfurized fatty acid esters can be obtained by sulfurizing esters of fatty acids. Said fatty acid esters are obtained by reaction between one or more fatty acids and alcohols of any kind, or by transesterification between one or more fatty acid esters and alcohols of any kind.

By sulfurized fatty acid ester, it is meant an ester of at least one sulfurized fatty acid, on the understanding that in most cases the ester is an ester of a mixture of sulfurized fatty acids.

The fatty acids able to be used to form the sulfurized fatty acid esters are all the fatty acids having 6 to 24 carbon atoms, preferably 14 to 22 carbon atoms, more preferably 16 to 20 carbon atoms. The fatty acids having 18 carbon atoms are the majority fatty acids i.e. they are contained in a weight concentration of at least 50% relative to the total weight of sulfurized fatty acid esters.

The sulfurized fatty acid esters can be sulfurized fatty acid monoesters, sulfurized fatty acid diesters, sulfurized fatty acid triesters, or sulfurized fatty acid polyesters, alone or in a mixture.

Preferred sulfurized fatty acid monoesters are $C_1$-$C_4$ alkyl monoesters such as methyl monoesters, ethyl monoesters, n-propyl monoesters, i-propyl monoesters, n-butyl monoesters, s-butyl monoesters, t-butyl monoesters. Preferably, the monoester is a methyl monoester. Preferably, the sulfurized fatty acid ester is a sulfurized fatty acid methyl ester.

As examples of sulfurized fatty acid triesters, mention can be made of the triglycerides of sulfurized fatty acids that are fully or partially esterified and therefore optionally comprise diesters and/or monoesters in addition to the triesters.

As examples of sulfurized fatty acid polyesters, mention can be made of the pentaerythritol esters of sulfurized fatty acids.

The sulfur-containing olefins are preferably sulfurized olefins and can be obtained for example by sulfurizing reaction of olefins with sulfur, sulfurized hydrogen, or sulfides of hydrated alkali metals e.g. sodium sulfide. One example of a preparation method of said sulfur-containing olefins is described for example in patents U.S. Pat. Nos. 4,344,854 and 5,135,670. A very broad range of olefins can be sulfurized. Preferably, sulfur-containing olefins are produced from isobutylene, diisobutylene, triisobutylene, tripropylene, or tetrapropylene.

In one preferred embodiment, the sulfur-containing olefins are chosen from among Sulfurized IsoButylenes (SIB).

In one embodiment, the grease composition of the invention does not comprise a polymer.

The inventors have discovered that the grease composition of the invention has good adhesivity without the addition of an additive of polymer type.

In one embodiment, the grease composition of the invention is substantially free of antiwear of amine phosphate type, of zinc diamyldithiocarbamate type and of zinc dialkyl dithiophosphate type.

By «substantially free», it is meant a proportion of less than 0.01% by weight.

In one embodiment, the grease composition of the invention is free of antiwear agent of amine phosphate type, free of antiwear of zinc diamyldithiocarbamate type, and free of antiwear of zinc dialkyl dithiophosphate type.

In one embodiment, the grease composition is substantially free of antiwear additives, preferably fully free of antiwear additives.

The inventors have discovered that the grease composition of the invention has good antiwear properties without the addition of an antiwear additive, in particular of amine phosphate type, of zinc diamyldithiocarbamate type and/or of zinc dialkyl dithiophosphate type.

In one embodiment the grease composition of the invention, relative to the total weight of the grease composition, comprises:

from 70 to 95% by weight, preferably 75 to 90% by weight of base oil(s);

from 3 to 20% by weight, preferably 4 to 15% by weight of thickener(s) chosen from among optionally hydroxylated lithium salts of fatty acids having 10 to 28 carbon atoms;

from 0.5 to 10% by weight, preferably 1 to 5% by weight of calcium carbonate having a D50 particle size ranging from 3 to 20 μm and a D90 particle size ranging from 10 to 50 μm.

In one embodiment the grease composition, relative to the total weight of the grease composition, comprises:

from 70 to 95% by weight, preferably 75 to 90% by weight of base oil(s);

from 3 to 20% by weight, preferably 4 to 15% by weight of thickener(s) chosen from among optionally hydroxylated lithium salts of fatty acids having 10 to 28 carbon atoms;

from 0.5 to 10% by weight, preferably 1 to 5% by weight of calcium carbonate having a D50 particle size ranging from 4 to 15 μm and a D90 particle size ranging from 10 to 40 μm.

In one embodiment the grease composition, relative to the total weight of the grease composition, comprises:

from 70 to 95% by weight, preferably 75 to 90% by weight of base oil(s) comprising at least one ester oil;

from 3 to 20% by weight, preferably 4 to 15% by weight of thickener(s) comprising at least one optionally hydroxylated lithium salt of fatty acid having 10 to 28 carbon atoms;

from 0.5 to 10% by weight, preferably 1 to 5% by weight of calcium carbonate.

In one embodiment the grease composition of the invention, relative to the total weight of the grease composition, comprises:

from 70 to 95% by weight, preferably 75 to 90% by weight of base oil(s) comprising at least one ester oil;

from 3 to 20% by weight, preferably 4 to 15% by weight of thickener(s) at least comprising lithium 12-hydroxystearate;

from 0.5 to 10% by weight, preferably 1 to 5% by weight of calcium carbonate having a D50 particle size ranging from 3 to 20 μm and a D90 particle size ranging from 10 to 50 μm.

In one embodiment the grease composition of the invention, relative to the total weight of the grease composition, comprises:

from 70 to 95% by weight, preferably 75 to 90% by weight of base oil(s) comprising at least one ester oil;

from 3 to 20% by weight, preferably 4 to 15% by weight of thickener(s) at least comprising lithium 12-hydroxystearate;

from 0.5 to 10% by weight, preferably 1 to 5% by weight of calcium carbonate having a D50 particle size ranging from 4 to 15 μm and a D90 particle size ranging from 10 to 40 μm.

In one embodiment the grease composition of the invention, relative to the total weight of the grease composition, comprises:

from 70 to 95% by weight, preferably 75 to 90% by weight of base oil(s) including at least one ester oil;

from 3 to 20% by weight, preferably 4 to 15% by weight of thickener(s) chosen from among optionally hydroxylated lithium salts of fatty acids having 10 to 28 carbon atoms;

from 0.5 to 10% by weight, preferably 1 to 5% by weight of calcium carbonate;

from 1 to 15% by weight, preferably 2 to 10% by weight of at least one additive chosen from among extreme-pressure additives.

In one embodiment the grease composition of the invention, relative to the total weight of the grease composition, comprises:

from 70 to 95% by weight, preferably 75 to 90% by weight of base oil(s) including at least one ester oil;

from 3 to 20% by weight, preferably 4 to 15% by weight of thickener(s) chosen from among optionally hydroxylated lithium salts of fatty acids having 10 to 28 carbon atoms;

from 0.5 to 10% by weight, preferably 1 to 5% by weight of calcium carbonate;

from 1 to 15% by weight, preferably 2 to 10% by weight of at least one additive chosen from among extreme-pressure additives chosen from among sulfurized fatty acid esters, sulfur-containing olefins, and mixtures thereof.

In one embodiment the grease composition of the invention, relative to the total weight of the grease composition, comprises:

from 70 to 95% by weight, preferably 75 to 90% by weight of base oil(s) including at least one ester oil;

from 3 to 20% by weight, preferably 4 to 15% by weight of thickener(s) chosen from among optionally hydroxylated lithium salts of fatty acids having 10 to 28 carbon atoms;

from 0.5 to 10% by weight, preferably 1 to 5% by weight of calcium carbonate having a D50 particle size ranging from 5 to 10 μm and a D90 particle size ranging from 10 to 30 μm;

from 1 to 15% by weight, preferably 2 to 10% by weight of at least one additive chosen from among extreme-pressure additives.

In one embodiment the grease composition of the invention, relative to the total weight of the grease composition, comprises:

from 70 to 95% by weight, preferably 75 to 90% by weight of base oil(s) including at least one ester oil;

from 3 to 20% by weight, preferably 4 to 15% by weight of lithium 12-hydroxystearate thickener;

from 0.5 to 10% by weight, preferably 1 to 5% by weight of calcium carbonate having a D50 particle size ranging from 3 to 20 μm and a D90 particle size ranging from 10 to 50 μm;

from 1 to 15% by weight, preferably 2 to 10% by weight of at least one additive chosen from among extreme-pressure additives.

In one embodiment the grease composition of the invention, relative to the total weight of the grease composition, comprises:

- from 70 to 95% by weight, preferably 75 to 90% by weight of base oil(s) including at least one ester oil:
- from 3 to 20% by weight, preferably 4 to 15% by weight of lithium 12-hydroxystearate thickener,
- from 0.5 to 10% by weight, preferably 1 to 5% by weight of calcium carbonate having a D50 particle size ranging from 4 to 15 μm and a D90 particle size ranging from 10 to 40 μm;
- from 1 to 15% by weight, preferably 2 to 10% by weight of at least one additive chosen from among extreme-pressure additives.

In one embodiment the grease composition of the invention, relative to the total weight of the grease composition, comprises:

- from 70 to 95% by weight, preferably 75 to 90% by weight of base oil(s) including at least one ester oil;
- from 3 to 20% by weight, preferably 4 to 15% by weight of lithium 12-hydroxystearate thickener;
- from 0.5 to 10% by weight, preferably 1 to 5% by weight of calcium carbonate having a D50 particle size ranging from 4 to 15 μm and a D90 particle size ranging from 10 to 40 μm;
- from 1 to 15% by weight, preferably 2 to 10% by weight of at least one additive chosen from among extreme-pressure additives selected from sulfurized fatty acid esters, sulfur-containing olefins, and mixtures thereof.

The grease composition of the inventions preferably has viscosity at 40° C. higher than or equal to 100 cSt, more preferably higher than or equal to 200 cSt, further preferably higher than or equal to 300 cSt, still further preferably higher than or equal to 400 cSt, and most preferably higher than or equal to 500 cSt.

The viscosity is preferably measured according to standard ASTM D445.

The grease composition of the invention preferably has a content of carbon of biological origin greater than or equal to 40% by weight, preferably at least 45% by weight relative to the total weight of the carbon atoms of the grease composition.

The content of carbon of biological origin, also called biogenic carbon content, can be determined according to the test method of ASTM D6866.

The grease composition of the invention can be prepared with any method known to skilled persons for the preparation of a grease. Preferably, a preformed thickener is used in the preparation method. Typically, the preparation method of the grease comprises a step to contact the thickener with the calcium carbonate in the base oil and a heating step to melt the soap (with formation of the grease). If additives are used, they can be added before or after cooling. After cooling, the grease composition is generally homogenized by grinding.

The invention also concerns the use of the grease composition in off-road, agricultural, wind energy machines, such as off-road vehicles and construction equipment, agricultural machinery and wind energy turbine.

Typically, the grease composition of the invention is used to lubricate a least one component of an off-road, agricultural or wind energy machine, preferably chosen from among construction equipment, agricultural machinery and wind energy turbines.

The invention also concerns a lubrication method of at least one component of an off-road, agricultural or wind energy machine, preferably chosen from among construction equipment, agricultural machinery and wind energy turbine, said method comprising contacting the component with a grease of the invention.

More particularly, the grease of the invention can be used in bearings (ball, roller, needle), rolling and slide bearings, open gears, metal cables and chain drives, and more generally in applications not comprising a sealing system.

All the characteristics and preferences described for the grease of the invention apply to the method for lubricating a component of an off-road vehicle according to the invention.

The invention is now described with the following examples evidently given as a nonlimiting illustration of the invention.

EXAMPLES

Example: Preparation of the Grease Compositions

Greases were prepared according to the following protocol:

The greases used in the examples are prepared as follows: the thickener and calcium carbonate are placed in the base oil and heated until melting of the soap. After cooling, the additives are added in different proportions and the grease composition is homogenized in a mill.

The prepared and tested grease compositions are detailed in Table 1 giving the proportions expressed by weight relative to the total weight of the grease composition.

TABLE 1

| | CC1 | CC2 | CC3 | CI4 |
|---|---|---|---|---|
| Base oil(s) | 84.60% | 85.40% | 84.70% | 84.70% |
| Thickener | 7.30% | 8.90% | 8.00% | 8.00% |
| CaCO3 (1) | 2.50% | | 3.00% | |
| CaCO3 (2) | | | | 3.00% |
| Antiwear | 1.50% | 1.50% | | |
| Additive package | 4.10% | 4.10% | 4.30% | 4.30% |

The base oil(s) comprise a mixture of two oils of ester type. The base oil(s) have 28-day biodegradability measured according to standard OECD 301B of 70% and 75%.

The thickener is lithium 12-hydroxystearate. It has 28-day biodegradability of 97%.

CaCO3 (1) is calcium carbonate having a D50 particle size of 2.14 μm and a D90 particle size of 8.04 μm.

CaCO3(2) is calcium carbonate having a D50 particle size of 7.08 μm and a D90 particle size of 14.9 μm.

The antiwear is an antiwear comprising a mixture of amine phosphates.

The additive package comprises an extreme-pressure additive of sulfurized ester type, an antioxidant, and a metal passivating additive.

Composition CI4 of the invention has 28-day biodegradability of 67.26%, calculated from the biodegradabilities of the base oils and thickener.

The particle size of the calcium carbonate used in the examples was measured using a laser diffraction method well known to skilled persons.

In this example, a Mastersizer Hydro R diffractometer by Malvern was used.

If macroscopic agglomerates are present (e.g. of size greater than 400 μm), mechanical screening can be employed with two different screen sizes (400 μm and 800 μm) to reduce the macroscopic agglomerates.

Should there still remain macroscopic agglomerates after mechanical screening, drying of the sample at 100° C. can be applied to further reduce the quantity of macroscopic agglomerates.

To interpret results, it is possible not to take into consideration the proportion of macroscopic agglomerates, with a cut-off for example of 100 μm, or 50 μm or 25 μm (according to agglomerate size). The cut-off does not have a significant impact on measurement of D50 or D90 particle size used in the examples.

Example 2: Determination of Antiwear and Extreme-Pressure Properties

The antiwear and extreme-pressure (EP) properties of the grease compositions detailed in Table 1 were determined and the results are given in Table 2.

TABLE 2

| | Norme | CC1 | CC2 | CC3 | CI4 |
|---|---|---|---|---|---|
| Antiwear: 4-ball 60 min 40 kgf | ASTM D-2266 | 0.67 mm | 0.62 mm | 0.65 mm | 0.54 mm |
| EP: 4-ball (weld load) | ASTM D-2596 | 620 kgf | 500 kgf | 620 kgf | 620 kgf |
| EP: 4-ball (load wear index) | ASTM D-2596 | 91.4 | 76 | 97.1 | 108.7 |

The results in Table 2 show that the grease composition of the invention CI4 has better antiwear and extreme-pressure properties than the grease compositions CC1, CC2 and CC3. Although the grease composition CI4 does not comprise an antiwear, it exhibits better antiwear properties than the grease compositions CC1 and CC2 comprising an antiwear additive The grease composition CI4 comprising a calcium carbonate of claimed particle size exhibits better antiwear properties than composition CC3 comprising a calcium carbonate of other particle size.

Example 3: Determination of Adhesivity

Compositions CC1 and CI4 were tested for their adhesivity using a water spray off test. The viscosity at 40° C. of the compositions was 680 cSt, measured according to standard ASTM D445.

The adhesivity is given in Table 3.

TABLE 3

| | Standard | CC1 | CI4 |
|---|---|---|---|
| Water spray off loss at 40 psi and 38° C. | ASTM D4049 - ISO 110009 | 22% | 10.4% |

The results in Table 3 show that composition CI4 has very good adhesivity. The grease composition of the invention is therefore particularly well suited for the components of off-road vehicles having low rotation speeds.

What is claimed is:

1. A grease composition comprising, relative to the total weight of the grease composition:

a) from 70 to 95% by weight of base oil(s) each having a 28-day biodegradability of at least 60% as measured according to standard OECD 301B;

b) from 1 to 20% by weight of thickener(s) chosen from among fatty acid metal salts, each thickener having a 28-day biodegradability of at least 60% as measured according to standard OECD 301B;

c) from 0.5 to 10% by weight of calcium carbonate having a D50 particle size greater than or equal to 3 μm and a D90 particle size greater than or equal to 10 μm.

2. The composition according to claim 1 comprising, relative to the total weight of the grease composition:

a) from 70 to 95% by weight of base oil(s) each having a 28-day biodegradability of at least 60% as measured according to standard OECD 301B;

b) from 2 to 20% by weight of thickener(s) chosen from among fatty acid metal salts, each thickener having a 28-day biodegradability of at least 60% as measured according to standard OECD 301B;

c) from 0.5 to 10% by weight of calcium carbonate having a D50 particle size greater than or equal to 3 μm and a D90 particle size greater than or equal to 10 μm.

3. The composition according to claim 1, characterized in that it has a 28-day biodegradability of at least 60%, calculated from the 28-day biodegradability of the base oil(s) and thickener(s), the 28-day biodegradability of the base oil(s) and thickener(s) being measured following the method of OECD 301B.

4. The composition according to claim 1, wherein the thickener is chosen from among optionally hydroxylated lithium salts of fatty acids, optionally hydroxylated calcium salts of fatty acids and the mixtures thereof.

5. The composition according to claim 1, wherein the base oils are chosen from among ester oils.

6. The composition according to claim 1, wherein the calcium carbonate has a D50 particle size ranging from 3 to 20 μm and a D90 particle size ranging from 10 to 50 μm.

7. The composition according to claim 1, further comprising at least one extreme-pressure additive.

8. The composition according to claim 1, said composition being free of antiwear additive of amine phosphate type, of zinc diamyldithiocarbamate type and of zinc dialkyl dithiophosphate type.

9. The composition according to claim 1, comprising at least 40% by weight of carbon of biological origin, relative to the total weight of the carbon atoms of the composition.

10. A method of lubricating at least one component of an off-road, agricultural or wind energy device, the method comprising contacting the component with the grease composition according to claim 1.

11. The method according to claim 10, wherein the off-road, agricultural or wind energy device is chosen from among construction equipment, agricultural machinery, and wind turbines.

12. The composition according to claim 1, wherein the thickener is chosen from among optionally hydroxylated lithium salts of fatty acids.

13. The composition according to claim 1, wherein the thickener is lithium 12-hydroxystearate.

14. The composition according to claim 1, further comprising at least one extreme-pressure additive in an amount ranging from 1 to 15% by weight relative to the total weight of the composition.

15. The composition according to claim 1, comprising at least 45% by weight of carbon of biological origin, relative to the total weight of the carbon atoms of the composition.

16. A grease composition comprising, relative to the total weight of the grease composition:

(a) from 70 to 95% by weight of base oil(s) each having a 28-day biodegradability of at least 60% as measured according to standard OECD 301B;

(b) from 1 to 20% by weight of thickener(s) chosen from among fatty acid metal salts, each thickener having a 28-day biodegradability of at least 60% as measured according to standard OECD 301B;

(c) from 0.5 to 10% by weight of calcium carbonate having a D50 particle size greater than or equal to 4 μm and a D90 particle size greater than or equal to 10 μm.

17. The grease composition according to claim 16, wherein the calcium carbonate has a D50 particle size ranging from 5 to 10 μm and a D90 particle size ranging from 10 to 30 μm.

* * * * *